US006460760B1

(12) United States Patent
Sass

(10) Patent No.: US 6,460,760 B1
(45) Date of Patent: Oct. 8, 2002

(54) TWO-UP ROTATED PRESSURE SEAL RETURN MAILER

(75) Inventor: Nancy M Sass, Lone Tree, IA (US)

(73) Assignee: Moore North America, Inc., Stamford, CT (US)

( * ) Notice: Subject to any disclaimer, the term of this patent is extended or adjusted under 35 U.S.C. 154(b) by 0 days.

(21) Appl. No.: 09/895,257

(22) Filed: Jul. 2, 2001

(51) Int. Cl.[7] ..... B65D 27/06
(52) U.S. Cl. ..... 229/305; 229/92.1
(58) Field of Search ..... 229/305, 92.1

(56) References Cited

U.S. PATENT DOCUMENTS 5,174,491 A 12/1992 Taylor et al.
5,201,464 A 4/1993 File
5,360,160 A 11/1994 Sauerwine et al.
5,372,302 A 12/1994 Loch et al.
5,376,048 A 12/1994 Whiteside
5,397,427 A 3/1995 Traise et al.
5,425,500 A 6/1995 Sauerwine
5,513,795 A 5/1996 Sauerwine
5,785,242 A 7/1998 Lombardo
5,829,670 A 11/1998 Lombardo et al.
6,003,760 A * 12/1999 Abercrombie ..... 229/305
6,015,085 A * 1/2000 Cannon et al. ..... 229/305
6,123,255 A * 9/2000 Chimera ..... 229/305
6,135,506 A 10/2000 Chess et al.
6,152,361 A * 11/2000 Abercrombie et al. ..... 229/305
6,196,453 B1 3/2001 Hutchinson

* cited by examiner

*Primary Examiner*—Jes F. Pascua
(74) *Attorney, Agent, or Firm*—Nixon & Vandehye PC

(57) ABSTRACT

An intermediate for a mailer type business form is provided that is Z-folded to produce a mailer type business form with built-in reply envelope. The mailer type business form is adapted to be used either as a mailing label or as a one-piece mailer. The mailer is of compact size, for example, about 7 inches×4 inches so as to facilitate its use as a mailing label on relatively small packages. First and second panels of the mailer define a reply envelope when the mailer is Z-folded. The third panel of the mailer is adapted to include invoice and/or remittance advice and may include a line of weakness to define a stub that can be inserted in the reply envelope with a check. The intermediate is printed in a rotated format to provide two forms about fourteen inches and also has rewettable glue and additional cohesive to create a postal compatible reply envelope.

21 Claims, 5 Drawing Sheets

100
10
110
Tear-off sides
Pop-Apart end
Rewettable Glue
92
1/2"
6"
31/2"
4"

TWO-UP ROTATED PRESSURE SEAL RETURN MAILER

BACKGROUND AND SUMMARY OF THE INVENTION

The invention relates to an intermediate for a business form such as a mailing label that incorporates an invoice and reply envelope in a one-part continuous form that can be printed, preferably in the simplex mode.

U.S. Pat. No. 6,135,506 teaches a packing list or bill of lading constructed by Z-folding an intermediate about first and second fold lines to define three plys with aligned first and second lines of weakness formed in the plys parallel to the first and second side edges, to define detachable side strips. Patterns of pressure activated cohesive secure the detachable side strips of the plys to each other and patterns of pressure sensitive adhesive covered by release liners are provided, disposed only in the detachable side strips, to hold the form in contact with a package when the release liners are removed.

The '506 mailer construction is adapted to be printed in portrait orientation. Further the mailer has substantially wide side strips for facilitating its adherence to a package and, thus, has a substantial widthwise dimension. Furthermore, the mailer is not adapted to forming a reply envelope and therefore the mailing label produced cannot incorporate an invoice and reply envelope.

According to one aspect of the present invention, an intermediate for a business form is provided that serves as a mailing label and further incorporates an invoice and reply envelope in a one-part, continuous form adapted to be simplex printed. Furthermore, the mailer is, in a preferred embodiment, provided in a compact size of about 8 inches×4 inches so as to be able to fit on relatively small or compact packages. While the compact size of the invention is particularly adapted for use as a mailing label, it is completely postal compatible so it may be used independently as a one-part mailer by service industries, such as utility companies and medical/dental office billings. The compact size of the mailer is further advantageous for customers who lease printer equipment and pay by the linear foot rather than cycle count. Indeed, the smaller size of the product reduces cost to the customer when larger areas of conventional mailers are not required for customer information.

It is an object of the invention to provide a pressure seal Z-fold reply envelope construction that can be used as a package mailing label or independently as a one-part mailer and that advantageously provides a top open reply envelope making the product friendlier and more versatile to the end user.

According to the present invention, an intermediate for a mailer type business form and the mailer itself are provided which achieves the objectives set forth above. The intermediate comprises a single quadrate sheet of paper, which may be easily run through a printer to print indicia on either one or both faces. In an exemplary embodiment, the outgoing address and the reply address are landscape printed on the same face of the intermediate and thus the intermediate is adapted to variable printing in the simplexed mode. The intermediate may be easily Z-folded to form the final mailer and sealed by conventional techniques. The mailer is easy to open and the reply envelope is easy to assemble and utilize.

According to a preferred embodiment of the invention, the forms are provided in a rotated format to provide two forms every fourteen inches. Thus, the top edge and the bottom edge of each individual intermediate mailer form is provided along first and second side edges of the continuous form fed for printing.

According to an embodiment of the invention, the face of the document has three equal panels, one panel, for example the top panel, serves a dual purpose. It is provided as the face of the outgoing mail piece and also defines the rear panel of the reply envelope, with the face that defined the outgoing mail piece front panel serving as the back face of the return mailer envelope. The second panel, for example the middle panel, defines the front panel of the reply envelope. The third panel, for example the bottom panel, defines the invoicing and/or remittance piece or portion.

The business form mailer intermediate provided according to the invention is imaged in the simplexed mode and then folded and sealed in a conventional manner. When the end user receives the document, the two vertical sides are removed and then the remainder of the document is opened by breaking adhesive regions defined at the bottom, using a letter opener, index finger, or the like. The statement is then detached from the document. The recipient fills out the remittance portion of the statement, if provided. A stub portion located at the top of the form is removed to define the back of the return mail piece. A check is then inserted along with the remittance stub or portion into the reply envelope and the envelope is sealed by wetting the adhesive flap of the reply envelope and applying it to the back of the return/reply mail piece.

Thus, according to one aspect of the present invention, an intermediate for a mailer type business form comprises a quadrate sheet of paper having parallel top and bottom edges, parallel first and second side edges perpendicular to the top and bottom edges, and first and second faces; first and second fold lines parallel to the top and bottom edges, and dividing the sheet into substantially equal size first, second, and third panels, an outgoing address area defined on the first face of the first panel, the outgoing address area being spaced from the first and second side edges; a reply address area defined on the first face of the second panel, the reply address area being spaced from the first and second side edges; an area for at least one of invoice and remittance information being defined on the first face of the third panel; first and second lines of weakness formed in the first, second and third panels, respectively parallel to and spaced from each of the first and second side edges; the first and second lines of weakness defining tear-off strips providing for ready opening of a mailer constructed by Z-folding the sheet about the fold lines; first adhesive areas provided at least in the tear-off strips for holding the first through third panels together as an outgoing mailer when the sheet is Z-folded about the fold lines; and second adhesive areas provided on the second face of the first and second panels for defining the first and second panels into a reply envelope that is substantially sealed along first and second side edges thereof.

A reply envelope closing flap is defined by a portion of the second panel and has an activatable, for example re-wettable, adhesive on the second face thereof for sealing the reply envelope. A line of weakness is formed in the first panel parallel to the top edge to define a removable stub for being removed when the reply envelope is formed.

In an exemplary embodiment, the first adhesive areas comprise spaced adhesive areas in the tear-off strips on the first face of the second and third panels and spaced adhesive areas in the tear-off strips on the second face of the first and second panels, and the first adhesive areas are sized and spaced so that when one intermediate is stacked upon another, so that the second face thereof is disposed on the first face of an adjacent intermediate, the first adhesive areas of the second and first faces of the intermediates, respectively, do not overlap.

According to another aspect of the invention, the intermediate of the invention is provided in a rotated format to provide two intermediate forms every fourteen inches. Thus, the invention is further embodied in a continuous feed intermediate form having a longitudinal axis and first and second longitudinal side edges comprising first and second intermediates, as described above, the intermediates being disposed in side-by-side relation so that top and bottom end edges of the intermediate are disposed parallel to a longitudinal axis of the continuous feed form and parallel to the longitudinal side edges of the continuous feed form.

According to yet a further aspect of the invention, a mailer type business form is provided that comprises: first, second, and third substantially equal size quadrate substantially opaque panels, the second panel being sandwiched between the first and third panels, and each panel having a first face and a second face, first and second side edges, and first and second end edges; outgoing address indicia provided on the first face of the first panel; reply address indicia provided on the first face of the second panel, the reply address indicia being inverted with respect to the outgoing address indicia; at least one of invoice and remittance indicia provided on the first face of the third panel; first adhesive patterns provided on the first panel second face and/or second panel second face for defining the first and second panels into a reply envelope that is substantially sealed along first and second side edges thereof; a reply envelope closing flap formed by a fold line defined in the second panel in parallel, spaced relation to the second end edge thereof and having activatable adhesive on the second face thereof for sealing the reply envelope; first and second lines of weakness formed in the first, second and third panels, respectively parallel to and spaced from each of the first and second side edges thereof; the first and second lines of weakness defining tear-off strips providing for ready opening of the mailer; and permanent adhesive areas provided at least in some of the tear-off strips for holding the first through third panels together.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
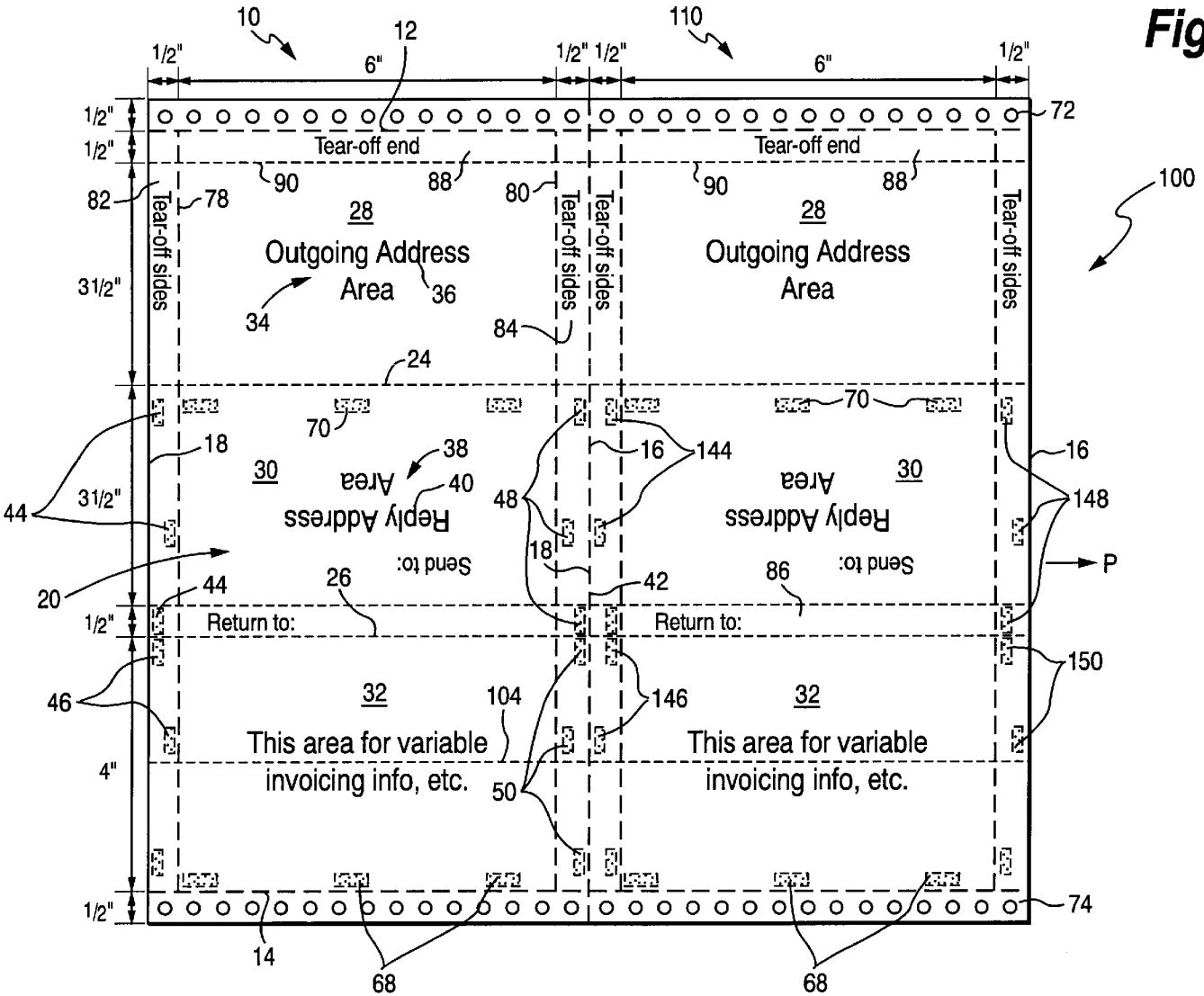
FIG. 1 is a plan view of a first face of an exemplary intermediate according to the present invention.
Figure 2:
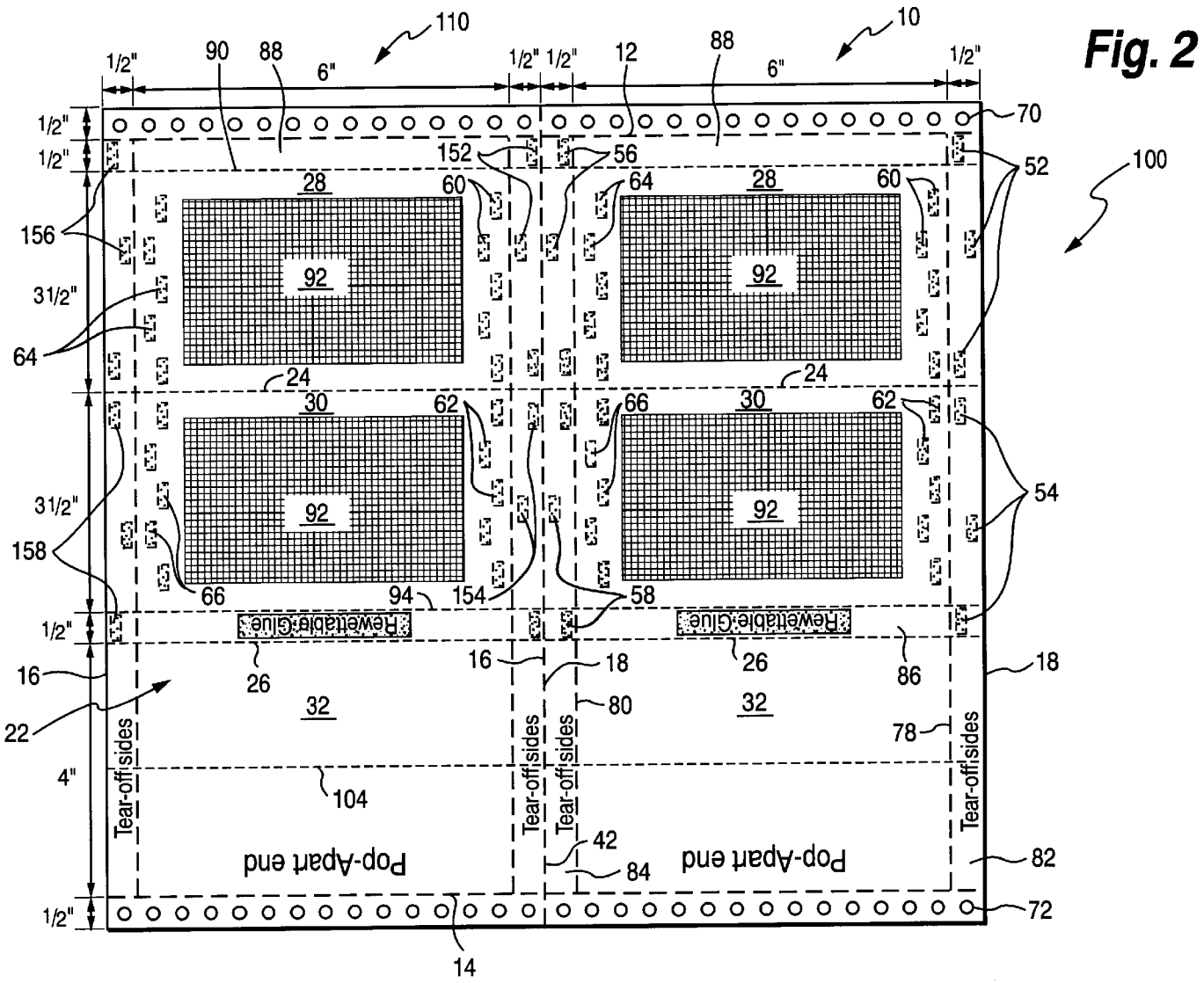
FIG. 2 is a plan view of the second face of the intermediate of FIG. 1.

A continuous feed sheet 100 of exemplary intermediates 10, 110 for a mailer type business form is shown in FIGS. 1 and 2. Each of the illustrated intermediates 10, 110 is substantially identical except that the Z-fold cohesive is staggered every 7 inches longitudinally of the continuous form to prevent blocking upon folding of the produced intermediates for storage, as described in greater detail below. Because the intermediate forms are substantially identical, as illustrated in FIGS. 1 and 2, corresponding reference numbers are used to identify corresponding features of each of the intermediates except that the second intermediate (the intermediate on the right in FIG. 1) and the staggered adhesive thereof are each labeled with a number incremented by one hundred as compared to the corresponding reference numerals used in the first intermediate 10 (on the left in FIG. 1). The description of the intermediate hereinbelow will be substantially confined to the description of a single intermediate except as appropriate for the description of the staggered cohesive. It is to be noted that for convenience, the intermediates will be described with reference to their top and bottom edges relative to a longitudinal axis thereof, even though in the continuous form it can be seen that the top and bottom edges of the intermediates actually define longitudinal side edges of the continuous form.

Each intermediate includes a quadrate sheet of substantially opaque paper (i.e., no windows and not fully translucent) having parallel top and bottom edges 12, 14 and parallel first and second side edges 16, 18, respectively. The side edges are perpendicular to the top and bottom edges. The sheet is further defined to include first and second faces 20, 22 (FIG. 1 and FIG. 2), respectively. First and second fold lines 24, 26 are provided parallel to the top and bottom edges, dividing the sheet of the intermediate into three substantially three-equal size panels 28, 30, 32.

With reference to the presently preferred, illustrated embodiment, the first panel 28 is disposed as the top panel of the form, the second panel 30 is disposed as the middle panel and the third panel 32 is disposed as the bottom panel of the intermediate 10 so that the second panel 30 is between the first and third panels 28, 32. Thus, the first panel 28 is between the top edge 12 and the first fold line 24, the second panel 30 is between fold lines 24, 26 and the third panel 32 is between fold line 26 and the bottom edge 14 of the intermediate. Fold lines 24, 26 may comprise lines of weakness such as perforation lines or die cut lines or may merely be scored or crease lines. In the presently preferred embodiment, where the third panel 32 is adapted to be removed and retained by the end user, fold line 26 is preferably a line of weakness that facilitates separation of the third panel 32 from the second panel 30. Furthermore, in the presently preferred embodiment, the first and second panels 28, 30 together define the reply envelope 76 and therefore, the first fold line 24 need not be adapted to be severed by the end user. As will become apparent below, the invention is not limited to the described series and orientation of the panels, except as required by the appended claims.

FIG. 1 shows the sheet 100 of intermediates after it is passed longitudinally, in the direction of arrow P, through a continuous laser printer or the like so that address information, such as the outgoing address and/or the reply address indicia is imaged on the intermediate. More specifically, the intermediate includes an outgoing address area 34 on the first face 20 of the first panel 28. The outgoing address area is of a size and defined by a media to receive e.g., a laser printed address or preprinted address label. The outgoing address area can include indicia comers or other indicator such as a change in texture, tone or color of the paper to facilitate the determination of the proper location of the outgoing address. Such indicators, however, are not critical to the effective implementation of the invention. Human readable address indicia, as shown only schematically by indicia 36 in FIG. 1, is ultimately landscaped imaged on the intermediate 10 such as after it has passed through the laser printer. Other human or machine readable indicia may also be preprinted on the first face of the first panel, such as a postal address bar coding (not shown), indicia for postal stamp application (not shown) and/or indicia for he sender's return address (not shown).

The intermediate also defines a reply address area 38 on the first face 20 of the intermediate 10, in the region defined by the second panel 30. The reply address area is of a size and media suitable for receiving human readable address indicia. Again, corner indicia or other print area designators, as described above with reference to the outgoing address area, may be provided to indicate the most preferred location of the reply address. In the presently preferred embodiment, the reply address indicia 40 is preprinted in the landscape mode in the reply address area, inverted relative to the outgoing address indicia 36, but the indicia 40 may be variably printed thereon or applied as a preprinted address label without departing from the concept of the invention. Thus, at some point, human readable reply address indicia shown schematically as in FIG. 2 is imaged in the reply address area. Other human or machine readable indicia may also be preprinted on the second face of the second panel, such as a postal address bar coding (not shown), indicia for postal stamp application (not shown) and/or indicia (not shown) for the end user to apply their own return address to the reply envelope 76.

First and second lines of weakness 78, 80 are formed in the first through third panels parallel to and spaced from each of the edges 16, 18. The first and second lines of weakness define tear off strips 82, 84 providing for ready opening of a mailer constructed by Z-folding the sheet of the intermediate about fold lines 24, 26, as shown in FIGS. 3 and 4.

Figure 3:
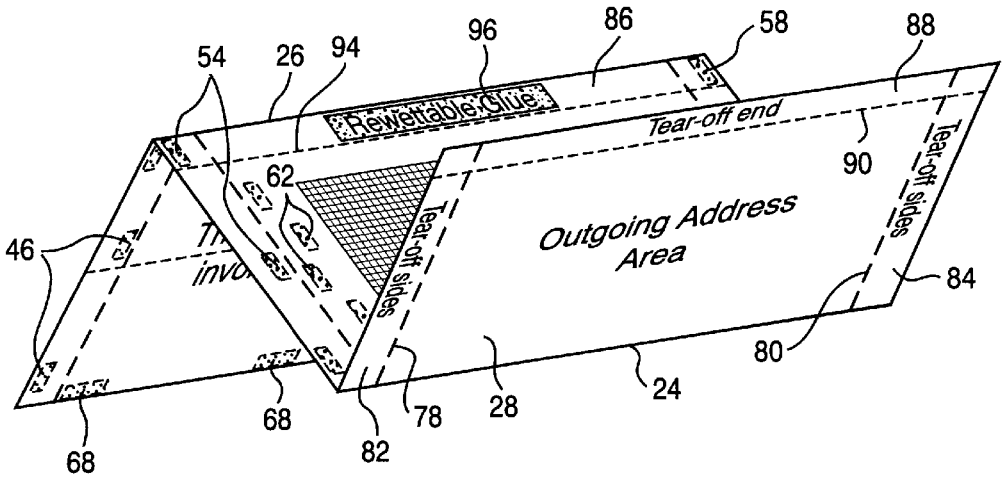
FIG. 3 is a perspective view showing the intermediate of FIGS. 1 and 2 being folded into a mailer type business form.
Figure 4:
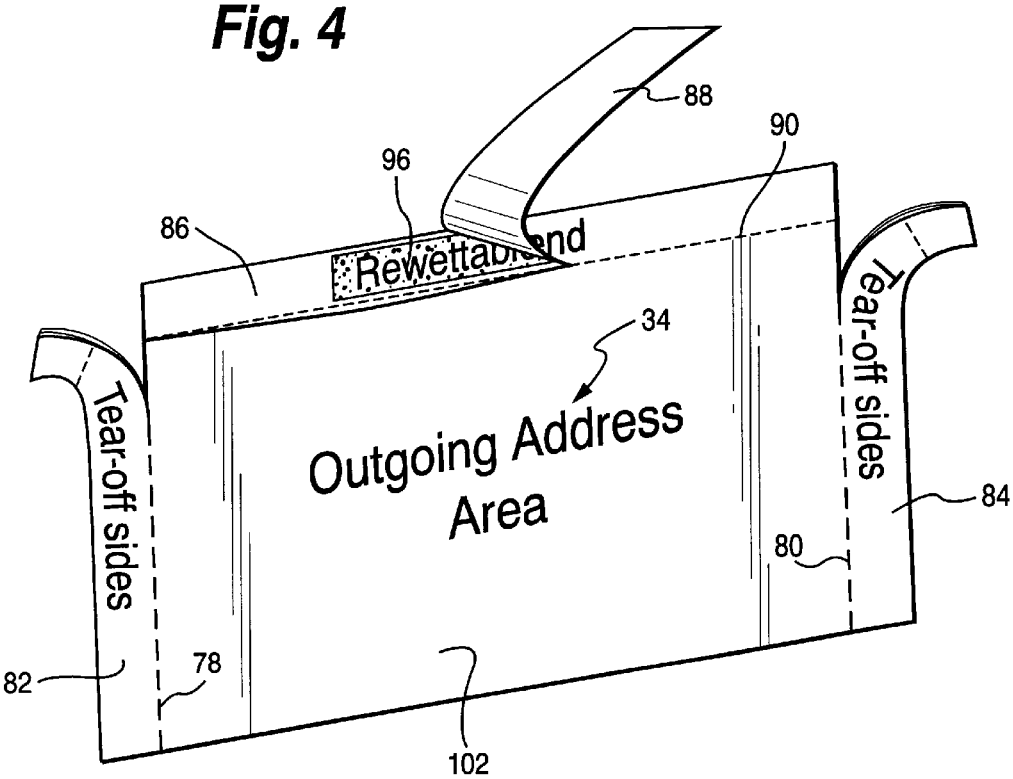
FIG. 4 is a perspective view showing removal of the tear off side strips of the mailer and removal of the top stub to reveal the re-wettable glue tab of the second panel.

The intermediates 10, 110 comprise a first plurality of adhesive patterns provided for holding the first through third panels together in the outgoing mailer configuration when the intermediate is Z-folded about the fold lines 24, 26, as illustrated in FIG. 3. In the first intermediate 10 these adhesive patterns include discontinuous strips or areas 44, 46, 48, 50, provided on the first face 20 of the second and third panels 30, 32 in the tear off strips 82, 84; and discontinuous strips or areas 52, 54, 56, 58, provided on the second face 22 of the first and second panels 28, 30, also in the tear off strips 82, 84.

Figure 5:
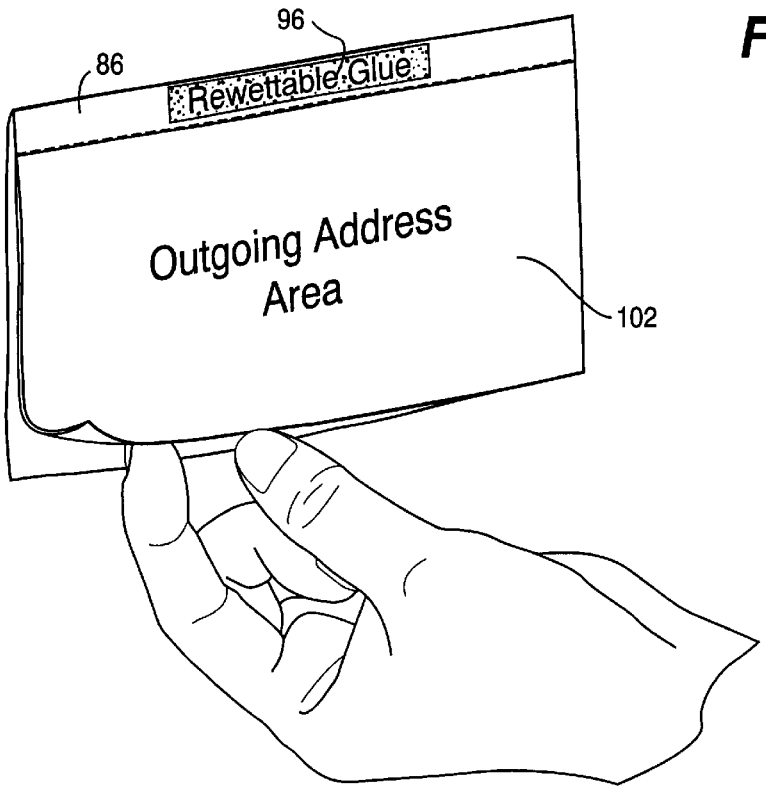
FIG. 5 is a perspective view showing the separation of the reply envelope from the statement and/or invoice defined on the third panel.

The first Z-fold adhesive patterns also preferably include one or more strips or segments for adhering the bottom edge of the Z-folded mailer. Thus, in the illustrated embodiment, pressure seal cohesive 68 is provided adjacent the bottom edge of the mailer and/or adjacent the second fold line at 70 for cooperating to adhere the second and third panels in the Z-fold configuration. Such adhesive patterns are preferably provided discontinuously on the respective edges of the second and third panels to facilitate disengagement of these edges by the end user with a letter opener or index finger, as shown in FIG. 5. The cohesive 68, 70 is preferably limited, as shown, since these portions of the mailer intermediate are retained as a part of the reply envelope and invoice/statement.

Most preferably, the adhesive for adhering the intermediate in the Z-fold mailer configuration is a substantially permanent adhesive that is defined by pressure seal adhesive or cohesive for sealing the mailer upon folding and the application of suitable pressure to the adhesive regions. In the alternative, however, the adhesive may be a re-wettable adhesive, or pressure sensitive adhesive covered by a protective strip. Also, at least some of the adhesive may be provided as continuous elements rather than discontinuous elements and/or in a pattern, shape or density other than that shown. Thus, the adhesive areas or patterns are not limited to the patterns illustrated in FIGS. 1 and 2. However, it is preferred that the amount and spacing of such adhesive material be sufficient to allow the mailer to be processed by U.S. postal service automated systems. This is less of a concern, however, where the Z-folded intermediate is applied as a mailing label rather than used as a single piece mailer The intermediates 10, 110 further comprise a second plurality of adhesive patterns to define two of the panels into a reply envelope. In the illustrated embodiment, the first and second panels 28, 30 are adapted to define the reply envelope. Thus, an adhesive pattern comprised of pressure activated adhesive areas 60, 62, 64, 66 is provided on the second face 22 of at least one of the first and second panels 28, 30 and most preferably on the second face of each of the first and second panels. Because the first and second panels that define the reply envelope are joined at fold line 24, adhesive for defining the reply envelope is unnecessary along that fold line. As illustrated, privacy screening areas 92 are also preferably pre-defined on the second face 22 of the first and second panels 28, 30.

Preferably, the adhesive for adhering the first and second panels for forming the reply envelope is a substantially permanent adhesive that is defined by pressure seal adhesive or cohesive for sealing the mailer upon folding and the application of suitable pressure to the adhesive regions. In the alternative, however, the adhesive may be re-wettable adhesive, or pressure sensitive adhesive covered by a release strip. Also, the adhesive may be provided as continuous elements rather than discontinuous elements in or in a pattern, shape or density other than that shown. Thus, the adhesive areas or patterns may take any configuration, not just the configuration illustrated in FIG. 2. However, it is preferred that the amount and spacing of such adhesive material be sufficient to allow the reply envelope to be processed by the U.S. Postal Service automated systems.

Preferably, adhesive is omitted from adjacent the top edge 12 of the second face 22 of the first panel 28 and from the second face 22 of the second panel 30 adjacent the second fold line 26 so as to ensure that the closure flap 86 for the reply envelope is not inadvertently removed when the removable stub 88 defined by line of weakness 90 on the first panel 28 is removed, as described below.

FIGS. 1 and 2 show intermediate 10 in combination with a second intermediate 110 which is essentially identical to intermediate 10 except with regard to the position of the patterns of cohesive, as described in greater detail herein below. The intermediates are connected to each other at a line of weakness 42, such as a perforated line, which will form the second side edge 18 of intermediate 110 and the first side edge 16 of intermediate 10 when detached, e.g., using a conventional detacher.

As earlier indicated, preferably the only significant difference between the intermediate 110 and the intermediate 10 is the particular positioning of the first areas of pressure activated cohesive. Thus, the areas of cohesive 44, 46; 144,146 are staggered in the length dimension on alternating intermediates and the areas of cohesive 48, 50; 148, 150 are staggered in the length dimension on alternating intermediates, so that when adjacent intermediates are folded about line of weakness 42, there is little or preferably no overlap between cohesive 44, 46 and cohesive 148, 150 and little or preferably no overlap between cohesive 48, 50 and cohesive 144, 146. Likewise, areas of cohesive 52, 54; 152, 154 are staggered in the length dimension on alternating intermediates and areas of cohesive 56, 58; 156, 158 are staggered in the length dimension on alternating intermediates to avoid overlap on fan folding. Finally adhesive areas 60, 62, 64, 66, 68, 70 are identically disposed on each intermediate 10,110, but are longitudinally staggered, with respect to the long axis of the sheet 100, so as to avoid overlap on fan folding about line 42.

As described above, at least some of the first adhesive areas, in particular those provided in the tear off side edges 82, 84 are staggered every 7 inches so that upon folding of the continuous form along the line of weakness 42 that separates adjacent intermediates 10, 110, the adhesive disposed in the tear off side edges will be disposed adjacent one another rather than in opposed facing relation. This minimizes the likelihood that the adjacent intermediates will undesirably adhere on folding for storage. As illustrated in FIG. 2, the second adhesive patterns for forming the reply envelope are also staggered so as to substantially prevent undesired adherence or blocking in the event the continuous form is folded along a line of weakness 42 between adjacent intermediates 10, 110.

As can also be seen from a comparison of FIGS. 1 and 2, according to a further feature of the invention, the first adhesive patterns are provided on the first and second faces of the intermediates so as to also prevent blocking when intermediates 10,110 are stacked upon themselves. More particularly, the first adhesive patterns are disposed such that adhesive areas 54, 154 are longitudinally shifted with respect to adhesive areas 44, 144 and adhesive areas 58,158 are longitudinally shifted with respect to adhesive areas 48, 148, so that adhesive overlap on stacking is avoided as well.

As mentioned above, the second panel 30 further comprises a reply envelope closing flap 86 having an activatable adhesive 96 on the second face thereof for sealing the reply envelope. More specifically, a line of weakness 94 is defined to extend at least to and between the first and second lines of weakness 78, 80 of the second panel 30. The line of weakness 94 may be a perforated line or die cut line or may be a scored or a crease line. The adhesive 96 is provided on the second face 22 of the thus defined flap 86, to secure the reply envelope 76 in a sealed configuration. The adhesive 98 may be a re-wettable adhesive or may be a pressure sensitive adhesive that is covered and protected prior to sealing the reply envelope by a removable liner or the like.

The first panel 28 includes a removable stub 88 defined by line of weakness 90 to allow the reply envelope flap 86 to be adhered to the first face 20 of the first panel 28, which defines the rear panel 102 of the reply envelope 76. In an exemplary embodiment, the removable stub has a transverse dimension of about ½ inch so that the resulting rear panel of the reply envelope has a transverse dimension about 3 ½ inches, corresponding identically to the dimensions of the front panel thereof.

In the illustrated embodiment, the intermediates are advantageously provided in a rotated format to provide two intermediates every fourteen inches. Thus, two intermediates are illustrated in side-by-side relation in FIGS. 1 and 2. Because the forms are provided in a rotated format, the forms together defining a continuous form where the top edges 12 of the intermediates 10, 110 are aligned so as to be parallel to the longitudinal axis P of the continuous form. As shown, detachable tractor drive/feed strips 72, 74 may be provided for feeding and driving the continuous strip of intermediates during processing. Such strips are conventional for facilitating handling of intermediate(s) for printing or the like during manufacture. Such strips are typically provided where intermediate(s) are in continuous form, and lines of weakness 42 are defined between adjacent intermediates. During normal processing, the tractor feed strips 72, 74 are slit off at an appropriate stage to expose the top and bottom edges.

FIG. 3 illustrates Z-folding of the intermediate 10 about fold lines 24, 26 after slitting off the tractor feed strips 72, 74 and detachment from the adjacent intermediates 110. It can be seen that adhesive areas 52, 60, 64, 56, on panel 28 will align respectively with adhesive areas 54, 62, 66, 58 on panel 30 while adhesive areas 44, 48, 70 on panel 30 will align with adhesive areas 46, 50, 68 on panel 32. While in this configuration, then, the mailer is passed through e.g. conventional pressure sealing equipment so that a pressure of about 100–200 psi is applied to the cohesive to effectively secure the panels to form a mailer, which may be then used as a mailing label or as a single piece mailer.

Typically, the intermediate, as seen in FIGS. 1 and 2, has a length between top and bottom edges of about 12 inches to ensure that all postal specifications are met by both the mailer and the reply envelope. Each mailer intermediate Z-folds to define an outgoing envelope or mailing label having dimensions of 7 inches×4 inches. The reply envelope in the illustrated embodiment has a width of about 6 inches. In the illustrated embodiment, each panel has a length of about 4 inches and the reply envelope desirably has a flap having a length of about ½ inch so that the dimensions of the reply envelope are on the order of 6×3 ½.

Indicia may be printed where ever desired although at least with respect to the first face of the first panel and the first face of the second panel the printed indicia is preferably limited to address and postal indicia. Various indicia and information may be printed on the first face of the third panel to instruct the end user to complete the remittance advice and/or to instruct the end user as to the detachment of the statement portion of the mailer, and on the first face of the first panel and the second face of the third panel to instruct the end user on opening the Z-fold mailer and stub removal for forming the reply envelope, as shown in FIG. 2. Other indicia may be provided as deemed necessary or desirable to instruct and direct the end user and/or as advertising.

In the illustrated embodiment, the third panel includes a line of weakness 104 so that this panel may be used both for invoicing and remittance advice. As an alternative to a transverse line of weakness, it is to be understood that a right angle line of weakness (not shown) may be provided, depending upon the size of the various portions required.

In the illustrated embodiment, the reply envelope will have the original outgoing address on the back. Any postage will either be removed upon removal of the stub 88 or will be covered by the rewettable glue flap 86. To reduce confusion for the Post Office, indicia such as "Return To:" can be provided on the back of the rewettable flap 86, as illustrated, to transform the original outgoing address into a 'return to sender' address. In addition, if desired, verbiage such as "Send To:" can be included, as illustrated, adjacent the reply address area 38 of the front panel of the reply envelope 76.

With the illustrated adhesive patterns, there will be some cohesive 70 on the bottom of the reply envelope 76, but since this mail piece is adapted to carry a postage stamp rather than a discounted meter rate, it does not present problems to the end user.

As noted above, the top of the outgoing envelope is not sealed across the width due to the placement of the rewettable glue 96 therebehind. Where the mailer is advantageously provided as a mailing label for a package, this should not present a problem. If used as a more conventional mailer, limited areas of adhesive and/or cohesive may be provided to tack this end of the mailer in a closed configuration.

As noted above, the Z-folded mailer of the invention may be advantageously used as a mailing label. In that form, preferably, only the side tear off strips 82, 84 are glued to the package to avoid undesirable adhesion of the invoice back face 22 to the package. To that end, adhesive may be disposed along the tear off sides 82, 84 on the second face 22 of the third panel 32, which defines the rear of the outgoing mail piece. The adhesive (not shown) may be covered with a suitable release liner prior to adhesion to the package. Reference is made to U.S. Pat. No. 6,135,506, the entire disclosure of which is incorporated herein by this reference, for a description of suitable adhesive and liner for adhering the tear off side edges of the mailing label to the package. In the alternative, the mailing label may be disposed within a surface mounted transparent pocket for retrieval by the end user on package arrival.

Figure 6:
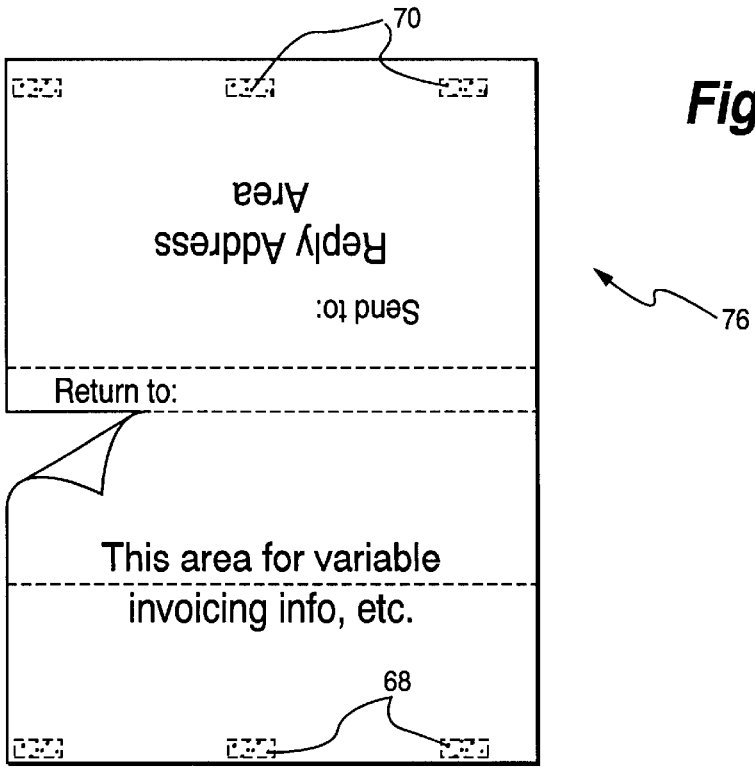
FIG. 6 is a plan view showing the removal of the statement and/or invoice third panel from the formed reply envelope.
Figure 7:
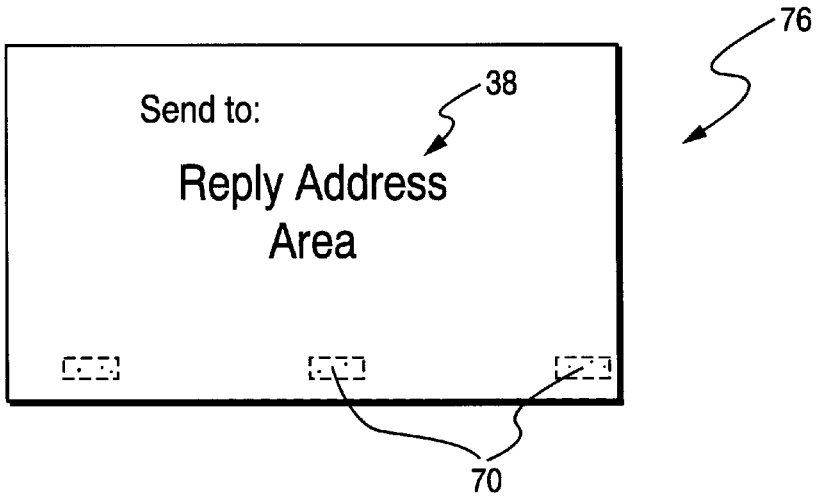
FIG. 7 is a plan view showing the front of the reply envelope according to the invention.
Figure 8:
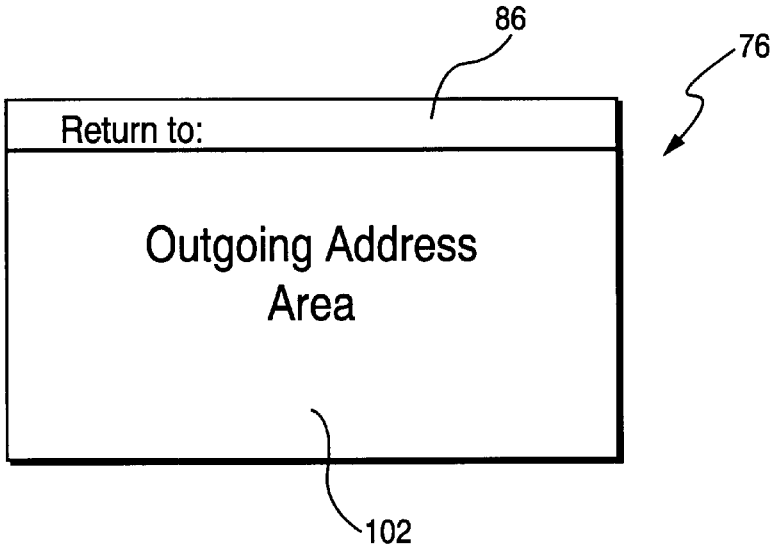
FIG. 8 is a perspective view showing the back or rear of a sealed reply envelope in accordance with the invention.

When the outgoing addressee receives the mailer, the panels 28, 30, 32 then comprise first, second and third plies or panels of the mailer with the second face 22 of the first panel 28 in face to face relation with the second face 22 of the second panel 30 and the first face 20 of the second panel 30 in face to face relation with the first face 20 of the third panel 32. The mailer can be easily opened, as illustrated in FIGS. 4 and 5, by tearing along lines of weakness such as perforation lines 78, 80 and by disrupting the adhesive 68, 70 along the bottom edge of the mailer with an index finger. Also, stub 88 is detached along the line of weakness 90 of the first panel/ply 28 to define the rear panel 102 of the reply envelope 76. The resultant opened mailer is illustrated in FIG. 6. Ultimately, the statement portion or panel 32 is separated along line 26, as shown by the arrow in FIG. 6. Once the remittance information has been completed, the check comprising the remittance is inserted into the reply envelope 76 together with the remittance stub. The filled reply envelope is then sealed by activating the adhesive 88, e.g., by wetting or removing a release strip (not shown) and applying the flap to panel 102.

The intermediate and mailer according to the present invention have a number of advantageous characteristics. All postal markings from the original outgoing envelope are hidden in the reply and the outgoing address is re-characterized as a return address. The reply envelope can offer all needed postal encoding for fast delivery and can be printer variable. The design is compact and easy to produce and store using all presently available sealing technology and is suitable for use as a mailing label or as a one-piece mailer.

It will thus be seen that according to the present invention, a simple and easy to construct, print, and utilize mailer has been provided. Further, the reply envelope flap folds to the back of the reply envelope as is most desirable for ease of use and aesthetics.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An intermediate for a mailer type business form, comprising:

a quadrate sheet of paper having parallel top and bottom edges, parallel first and second side edges perpendicular to the top and bottom edges, and first and second faces;

first and second fold lines parallel to said top and bottom edges, and dividing said sheet into substantially equal size first, second, and third panels, an outgoing address area defined on said first face of said first panel, said outgoing address area being spaced from said first and second side edges;

a reply address area defined on said first face of said second panel, said reply address area being spaced from said first and second side edges;

an area for at least one of invoice and remittance information being defined on said first face of said third panel;

first and second lines of weakness formed in said first, second and third panels, respectively parallel to and spaced from each of said first and second side edges;

said first and second lines of weakness defining tear-off strips providing for ready opening of a mailer constructed by Z-folding said sheet about said fold lines;

first adhesive areas provided at least in said tear-off strips for holding said first through third panels together as an outgoing mailer when said sheet is Z-folded about said fold lines;

second adhesive areas provided on said second face of said first and second panels for defining said first and second panels into a reply envelope that is substantially sealed along first and second side edges thereof; and a reply envelope closing flap formed in said second panel, extending parallel to said top and bottom edges of said sheet and having a third adhesive area on said second face thereof for sealing the reply envelope along a top edge thereof.

2. An intermediate as recited in claim 1, wherein said first panel is disposed between said top edge and said first fold line, said third panel is disposed between said bottom edge and said second fold line, and said second panel is disposed between said first and third panels.

3. An intermediate as recited in claim 2 wherein said second fold line is a line of weakness.

4. An intermediate as recited in claim 1, wherein said third adhesive area comprises a rewettable adhesive.

5. An intermediate as recited in claim 1, wherein said first and second adhesive areas comprise a permanent adhesive.

6. An intermediate as recited in claim 1, wherein said reply envelope closing flap is defined by a third line of weakness formed in said second panel parallel to and adjacent said second fold line.

7. An intermediate as recited in claim 6, further comprising a fourth line of weakness formed in said first panel parallel to and adjacent to said top edge, said fourth line of weakness being spaced from said top edge that is at least as great as a distance that said third line of weakness is spaced from said second fold line.

8. An intermediate as recited in claim 1, wherein said first adhesive area further includes strips of adhesive disposed on said first face of said third panel adjacent a bottom end edge thereof.

9. An intermediate as recited in claim 1 wherein a distance between said side edges is about seven inches.

10. An intermediate as recited in claim 1 further comprising human readable address indicia imaged in said outgoing address area.

11. An intermediate as recited in claim 1, wherein the distance between said top and bottom edges of the unfolded sheet is at least about twelve inches.

12. An intermediate as recited in claim 1, wherein said first adhesive areas comprise spaced adhesive areas in said tear-off strips on said first face of said second and third panels and spaced adhesive areas in said tear-off strips on said second face of said first and second panels, and wherein said first adhesive areas are sized and spaced so that when one intermediate is stacked upon another, so that the second face thereof is disposed on the first face of an adjacent intermediate, the first adhesive areas of said second and first faces of said intermediates, respectively, do not overlap.

13. An intermediate as recited in claim 1, wherein said quadrate sheet is a first sheet; and in combination with a second quadrate sheet substantially identical to said first sheet except for the positioning of said first adhesive areas in said tear-off strips, said first and second sheets separated by a line of weakness between said first side edge of said first sheet and said second side edge of said second sheet, and wherein said first adhesive areas in said tear-off strips on said first face of said first sheet are staggered with respect to said first adhesive areas in said tear-off strips on said first face of said second sheet, whereby if said sheets are accordion folded about said line of weakness therebetween, said first adhesive areas of said first sheet and said first adhesive areas of said second sheet do not overlap.

14. A mailer type business form, comprising:

first, second, and third substantially equal size quadrate substantially opaque panels, said second panel being sandwiched between said first and third panels, and each panel having a first face and a second face, first and second side edges, and first and second end edges;

outgoing address indicia provided on said first face of said first panel;

reply address indicia provided on said first face of said second panel, said reply address indicia being inverted with respect to said outgoing address indicia;

at least one of invoice and remittance indicia provided on said first face of said third panel;

first adhesive patterns provided on at least one of said first panel second face and said second panel second face for defining said first and second panels into a reply envelope that is substantially sealed along first and second side edges thereof;

a reply envelope closing flap formed by a fold line defined in said second panel in parallel, spaced relation to said second end edge thereof and having activatable adhesive on said second face thereof for sealing the reply envelope, said second panel being free from any line of weakness disposed parallel to said second end edge thereof between said fold line and said second end edge thereof;

first and second lines of weakness formed in said first, second and third panels, respectively parallel to and spaced from each of said first and second side edges thereof;

said first and second lines of weakness defining tear-off strips providing for ready opening of the mailer; and permanent adhesive areas provided at least in some of said tear-off strips for holding said first through third panels together.

15. A mailer as recited in claim 14, wherein said second end edge of said first panel is coupled to said first end edge of said second panel, and further comprising a third line of weakness formed in said first panel parallel to said first end edge thereof and spaced from said first end edge the same distance said fold line is spaced from said second end edge of said second panel, said first panel being free from any line of weakness parallel to said first end edge between said third line of weakness and said first end edge thereof.

16. A mailer as recited in claim 15, wherein said distance said fold line is spaced from said second end edge of said second panel is about one half inch.

17. A mailer as recited in claim 15, wherein said permanent adhesive areas further include adhesive areas disposed on said first face of said third panel adjacent said second end edge.

18. A mailer as recited in claim 14, wherein said first, second and third panels are of paper, and wherein said first, second and third panels are connected together at mutually adjacent end edges as an integral sheet of paper.

19. A mailer as recited in claim 14, wherein the distance between said first and second side edges is about seven inches.

20. A mailer as recited in claim 14, wherein the distance between said first and second edges of the first panel is at least about four inches.

21. A mailer as recited in claim 20, wherein said first panel second face faces said second panel second face.

* * * * *